US005388928A

United States Patent [19]

Kumagai

[11] Patent Number: 5,388,928

[45] Date of Patent: Feb. 14, 1995

[54] FLEXIBLE MEMBRANEOUS WEIR

[75] Inventor: Yuji Kumagai, Yokohama, Japan

[73] Assignee: Bridgestone Corporation, Tokyo, Japan

[21] Appl. No.: 90,781

[22] Filed: Jul. 13, 1993

[30] Foreign Application Priority Data

Jul. 13, 1992 [JP] Japan ..... 4-207044

[51] Int. Cl.[6] ..... E02B 7/20

[52] U.S. Cl. ..... 405/115; 405/87

[58] Field of Search ..... 405/115, 114, 91, 87, 405/52

[56] References Cited

U.S. PATENT DOCUMENTS 4,299,514 11/1981 Muramatsu et al. ..... 405/115

5,067,851 11/1991 Fujisawa et al. ..... 405/115

FOREIGN PATENT DOCUMENTS 0282508 12/1986 Japan ..... 405/115

*Primary Examiner*—Dennis L. Taylor

*Attorney, Agent, or Firm*—Sughrue, Mion, Zinn, Macpeak & Seas

[57] ABSTRACT

In a flexible membraneous weir 1 having a bag made of a flexible membrane 2 such as a rubber membrane or the like laid on a river bed and slope surfaces of the both river sides across the river and adapted to be erected or collapsed by charging or discharging fluid to or from the aforementioned bag, a rigid fin 10 is provided partly at a predetermined location along the river width direction of the outer surface of the above-mentioned flexible membrane 2. In this flexible membraneous weir, when it is collapsed, V-notch deformation is generated surely at the location corresponding to the above-mentioned rigid fin.

7 Claims, 5 Drawing Sheets

FLEXIBLE MEMBRANEOUS WEIR

BACKGROUND OF THE INVENTION

The present invention relates to a flexible membraneous weir available as weirs for intake of agricultural water or the like.

A flexible membraneous weir (normally made of rubber and otherwise called rubber weir) laid across a river is erected or collapsed by charging or discharging fluid to or from a bag. Especially in a weir erected or collapsed by charging or discharging air, as the air in the bag is discharged at the time of collapse, a height of the top wall of the bag would not lower uniformly according to lowering of an inner pressure, rather a so-called V-notch phenomenon, in which the top wall deforms in the shape of a letter "V" at one portion or two portions in the river width direction, would occur, and a flow of the river would concentrate into the V-notch location.

The position where the V-notch phenomenon occurs would vary and would not be constant due to the fact that the position of the center of flow varies depending upon the shape of the river at the location where the rubber weir is laid. It also varies depending upon the state of flow and the mode of construction of the rubber weir.

If the V-notch phenomenon would occur at an inadequate location, then in some cases the river bed at downstream side of the V-notch deformation would be scoured, resulting in change of a shape of the river.

Therefore, in a flexible membraneous weir disclosed in U.S. Pat. No. 4,662,783, a river bed surface on the downstream side at the location of the weir, where the V-notch deformation is desired to occur is excavated and a recess is formed there.

In this flexible membraneous weir, at the time of collapse, when the inner pressure has lowered to a certain extent, a membrane portion corresponding to the above-mentioned recess would sink in that recess, and V-notch deformation would occur at that membrane portion.

Observing the process of occurrence of this V-notch deformation, under the condition where the bag of the membraneous weir erects perfectly the bag is held erected upwards by a tension without sinking in the above-mentioned recess, but while the air in the bag is being discharged for the purpose of collapsing, when an inner pressure of the bag has lowered to a certain extent, the downstream side of the portion of the bag corresponding to the recess would sink in the recess, and as pulled by this sunk bag portion, the upstream side of the same bag portion would become sunk, and thereby a V-notch deformation is formed.

As described above, since a V-notch deformation is formed on the upstream side indirectly as a result of sinking of the downstream side of the bag, there exists a possibility that a V-notch deformation may occur earlier at an unpredictable location due to any other important factor.

In addition, in order to excavate the river bed surface, a construction expense becomes large and a construction term is also elongated.

Frequently, such a flexible membraneous weir is used for intake of a river water as agricultural water for example. In this case, the flexible membraneous weir is laid across a river at downstrae side of a water intake which is provided in either bank of the river and branches off from that river. When the weir is erected, water level of the river at upstream of the weir is raised to allow a sufficient quantity of the river water to flow into the water intake.

However, earth and sand are apt to accumulate in the portion of the water intake to reduce the intake flow rate through the water intake.

The present invention has been worked out in view of the above-mentioned circumstance in the prior art.

SUMMARY OF THE INVENTION

It is therefore one object of the present invention to provide at a low cost, a flexible membraneous weir in which a V-notch deformation can be surely generated at a fixed position.

In order to achieve the aforementioned object, according to one feature of the present invention, in a flexible membraneous weir consisting of a bag made of a flexible membrane such as a rubber membrane or the like laid on a river bed across a river and adapted to be erected or collapsed by charging or discharging fluid to or from the above-mentioned bag, a rigid fin projecting from the outer surface of the above-mentioned flexible membrane when the aforementioned flexible membraneous weir is erected, is provided partially at a predetermined location along the river width direction of the outer surface of the above-described flexible membrane.

According to the present invention, owing to the above-mentioned structural feature, when the fluid in the bag of the above-mentioned membraneous weir is discharged and the inner pressure has lowered, V-notch deformation can be surely generated at a fixed position because the bag of the membraneous weir becomes sunken firstly at the location of the rigid fin, which is subjected to a resistance force caused by an overflow to the maximum extent.

According to another feature of the invention, the above-mentioned flexible membraneous weir is laid at downstream side of a water intake which is provided in either bank of the river and branches off from the river. The above-mentioned rigid fin is provided on the outer surface of the flexible membrane at a longitudinal end portion near the bank provided with the water intake.

In this flexible membraneous weir, when the weir is collapsed, V-notch deformation is surely generated at the location of the rigid fin, that is, at the side near to the bank provided with the water intake and the river flow concentrates on this side to wash out downstream earth and sand which have accumulated in the portion of the water intake. Therefore, the condition can be avoided where the intake flow rate through the water intake is reduced by the accumulation of the earth and sand when the river water is taken out through the water intake.

The above-mentioned and other objects, features and advantages of the present invention will become more apparent by reference to the following description of preferred embodiments of the invention taken in conjunction with the accompanying drawings.

DETAILED DESCRIPTION OF THE PREFERRED EMBODIMENTS

Now a description will be made on one preferred embodiment of the present invention illustrated in FIGS. 1 to 4.

Figure 1:
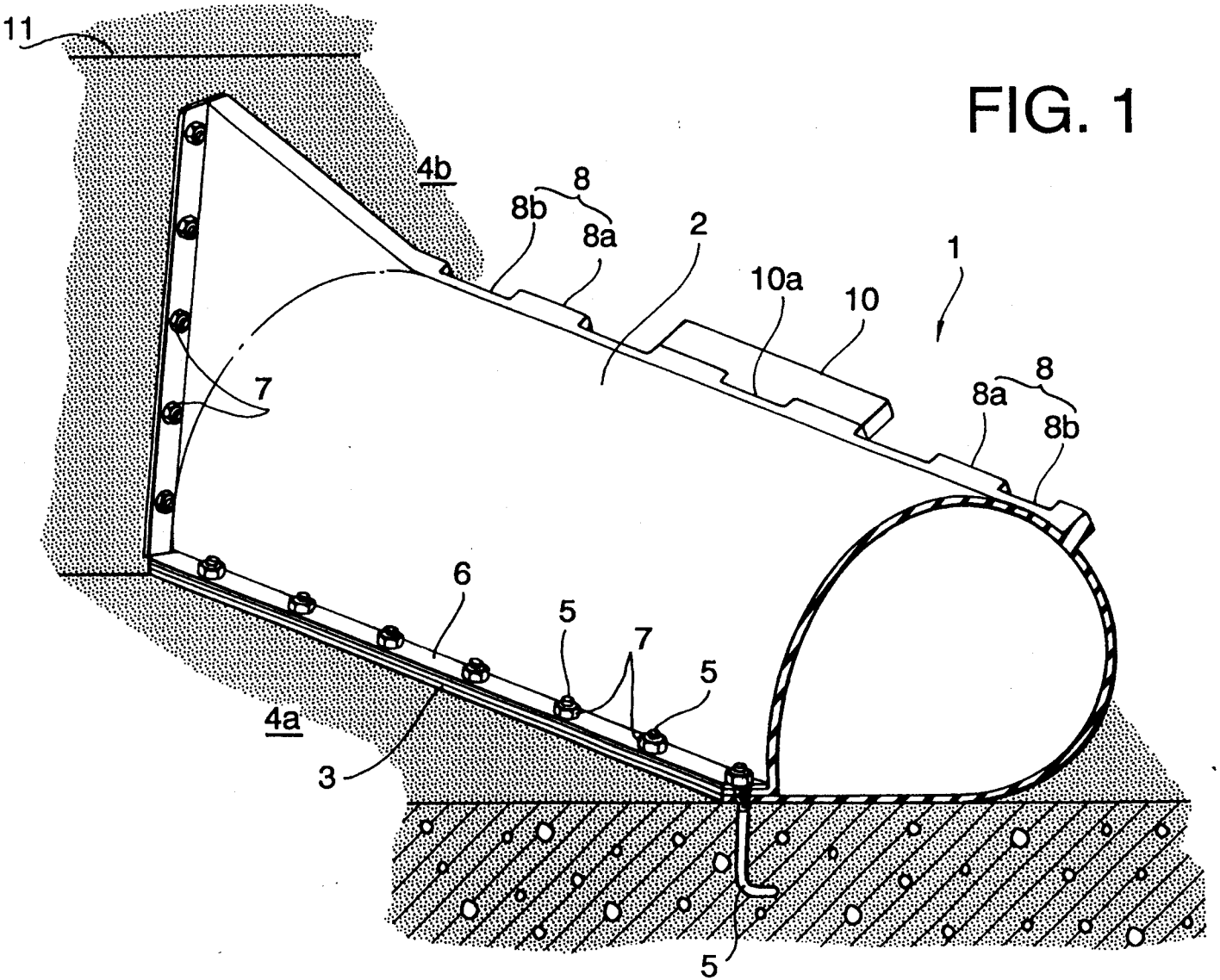
FIG. 1 is a partial perspective view of a rubber weir according to one preferred embodiment of the present invention.

A rubber weir 1 is water-tightly laid on a concrete river bed over its bottom surface 4*a* and its slope surfaces 4*b* on the both sides, and extends across the river. It is to be noted that FIG. 1 shows only a portion of the rubber weir 1 near a slope surface 4*a* on one side of the river.

The rubber weir 1 forming one kind of flexible membraneous weir employs, as its principal constituent member, a rubber sheet 2, which was produced by folding one or a plurality of strip-shaped fabrics made of cotton, synthesized fibers, cords and the like in two layers, impregnating the fabrics with crude rubber under the folded condition and vulcanizing and shaping the same.

The produced rubber sheet 2 is disposed on an upper surface of a concrete river bed 4 with the superposed edges 3 positioned on the upstream side. Anchor bolts 5 studded in the concrete river bed 4 as aligned in the river width direction penetrate through the edges 3, and the rubber sheet 2 is firmly secured to the river bed 4 by pressing with a press metal 6 and fastening with nuts 7.

When air is charged into the bag-shaped rubber weir 1 formed by the rubber sheet 2 in the above-described manner, the rubber weir 1 is erected, and the folded edge portion positioned on the downstream side forms a projecting fin 8 extending in the river width direction along the surface of the rubber weir 1.

Water flowing over the erected rubber weir peels off from the surface of the rubber weir on the downstream side thereof and falls. At this time, due to a varying negative pressure generated between the falling water and the rubber weir, vibrations are induced in the rubber weir. Also, if the frequency of the above-mentioned negative pressure variation coincides with the natural frequency of the rubber weir, the rubber weir vibrates largely due to resonance.

In order to avoid this resonance, along the edge of the fin 8 are alternately formed protruded portions 8*a* and recessed portions 8*b* by partly notching the fin 8. When the overflowing water peels off at the fin 8 and falls, it is severed into water flows passing the protruded portions 8*a* and water flows passing the recessed portions 8*b*, and therefore, negative pressure variations enough to make the entire weir resonate would not occur.

In such rubber weir 1, in order to make the above-mentioned V-notch deformation arise at a predetermined position, a rigid fin 10 projecting further than the protruded portions 8*a* is fixedly secured to a portion of the fin 8 corresponding to the location where the aforementioned V-notch deformation is desired to arise.

In FIG. 1, the river water flows from left hand to right hand and 11 is the left bank of the river. In the left bank 11 there is provided a water intake (not shown, see FIG. 8) at upstream side of the weir 1. The rigid fin 10 is provided between adjacent protruded fin portions 8*a* at a position close to the left.

The rigid fin 10 has a protrusion 10*a* corresponding to a recessed portion 8*b* of the fin formed between the adjacent protruded fin portions 8*a*, and is bonded to the fin 8 with the protrusion 10*a* fitted in the recessed portion 8*b* of the fin.

The rigid fin 10 is generally made of iron, but lead, plastics and the like could be employed as the material of the rigid fin 10 provided that it has a high rigidity.

FIGS. 1 through 4 illustrate the successive steps in the process of collapsing of the above-described rubber weir 1.

Figure 2:
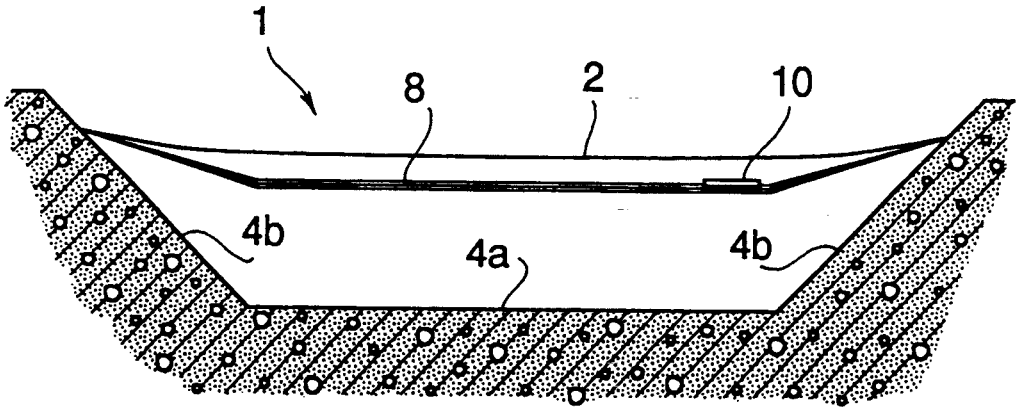
FIG. 2 is a front view of the same rubber weir at the time of perfect erection.

When air has been charged into the rubber weir 1, that is, into the bag-shaped rubber sheet 2 and it is held in a perfectly erected state, since the pressure within the rubber sheet is high, the rubber sheet 2 presents a bag-shaped state uniformly tensioned over its entire length in the river width direction as shown in FIG. 2. If there is an overflow, the rubber sheet 2 would be subjected to a maximum resistant force at the position of the rigid fin 10, but the rubber sheet 2 maintains the above-mentioned tensioned bag-shaped state against this resistant force.

Figure 3:
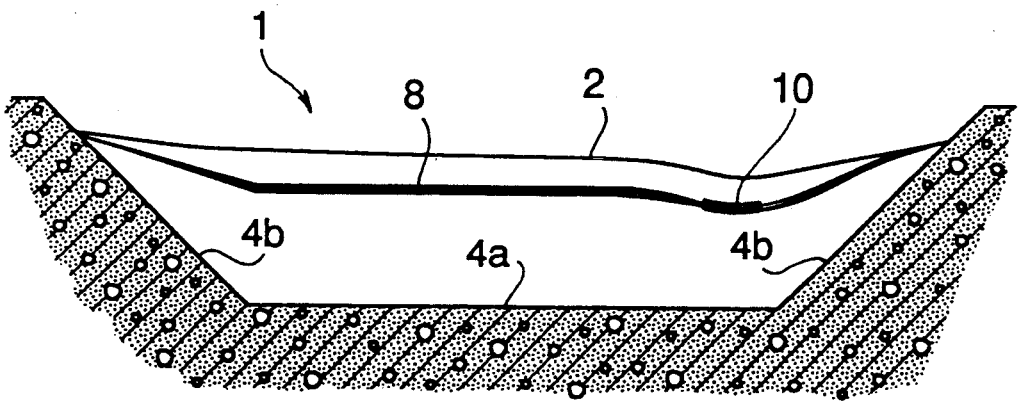
FIG. 3 is a front view of the same rubber weir showing an initial stage of a collapsing process.
Figure 4:
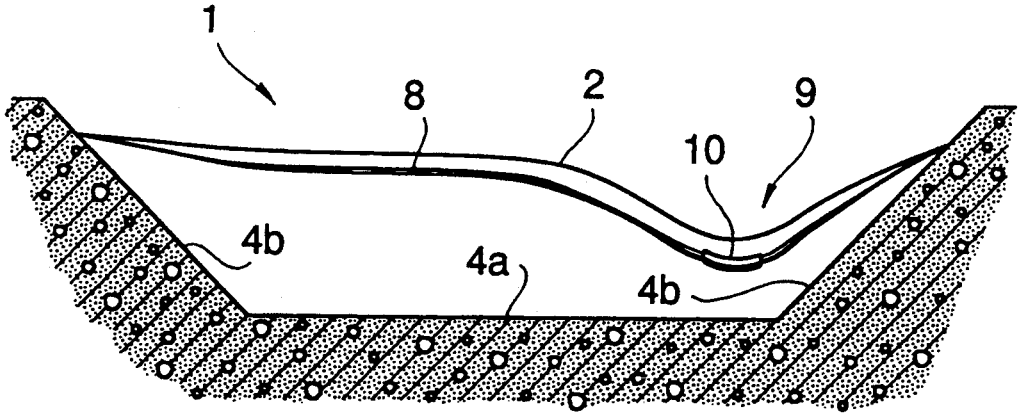
FIG. 4 is a front view of the same rubber weir showing a middle stage of the collapsing process.

As the rubber weir 1 is collapsed by discharging air in the rubber sheet 2, the tension of the rubber sheet 2 is relaxed due to lowering of the pressure within the rubber sheet 2, the portion of the rubber sheet 2 at the location of the rigid fin 10 near to the right-hand end, where it is subjected to the maximum resistant force, sinks first as shown in FIG. 3. Once sinking occurs, since an overflow rate at the same portion is the maximum, the sinking would be enlarged and V-notch deformation 9 is formed as shown in FIG. 4.

It is to be noted that even without relying upon an overflow, if an inner pressure is lowered due to discharge of air, sinking would occur first at the same location due to the weight of the rigid fin 10, and V-notch deformation 9 is formed.

In the above-described manner, V-notch deformation can be surely generated at the location where the rigid fin 10 was mounted.

Preferably, Young's modulus of the rigid fin 10 should be 200 $Kgf/mm^2$ or more and the width in the river width direction of the rigid fin 10 be 500 mm or more and less than half of the river bed width. If the width of the rigid fin 10 is less than 500 mm, the fin 10 would not be able to cause V-notch deformation surely. If the width is more than half of the river bed width, a position of generated V-notch deformation would become indefinite so that it is impossible to generate V-notch deformation at an intended exact position.

Similarly, the length of the fin 10 projecting from the rubber sheet 2 should be preferably 50 mm or more and less than 50% of the height of the erected rubber sheet 2.

Figure 8:
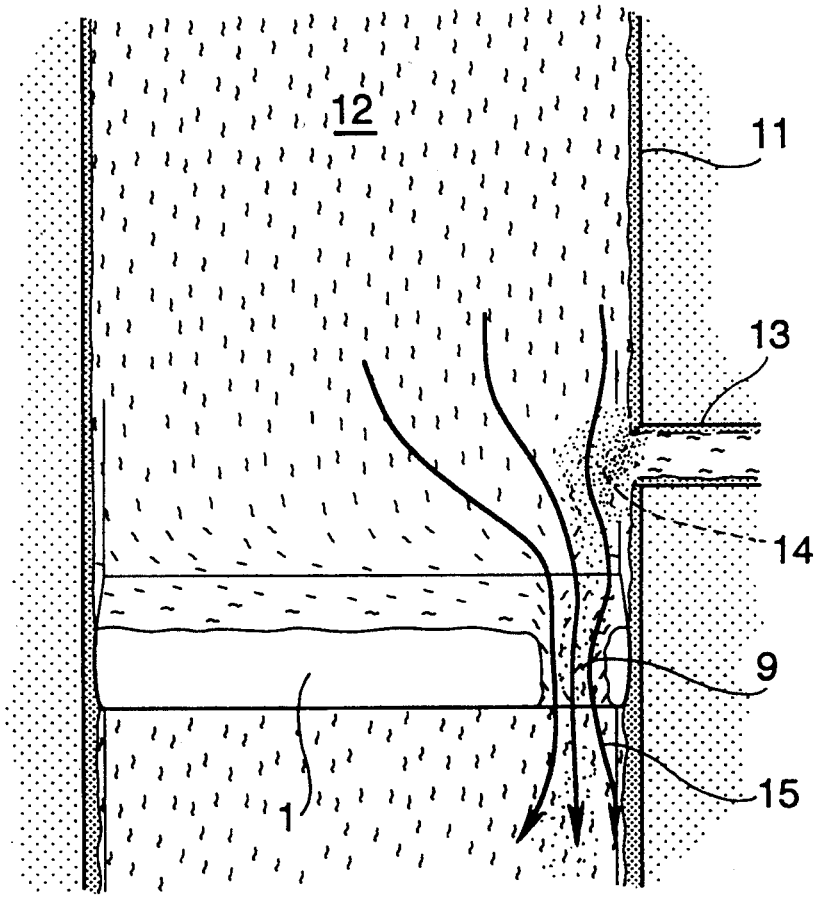
FIG. 8 is a plan view of a river in the vicinity of a rubber weir according to the present invention.

FIG. 8 is a schematic plan view of a river 12 provided with the rubber weir 1. In the left bank 11 (viewed in the direction of flow) of the river 12, there is provided a water intake 13 through which the river water is removed as agricultural water. The rubber weir 1 is laid at a downstream side of the water intake 13. The intake of water is carried out in a state that the rubber weir 1 is erected and the water level of the river 12 at upstream side of the weir 1 is raised.

On the inlet portion of the water intake 13, earth and sand are apt to accumulate as shown by dots 14 in FIG. 8. The accumulated earth and sand tend to reduce the intake flow rate through the water intake 13.

However, since the rigid fin 10 is mounted on the side of the rubber weir 1 near the left bank 11 provided with the water intake 13, when the rubber weir 1 is collapsed, V-notch deformation 9 occurs on the same side and the river flow concentrates on this side near to the left bank 11 as shown by arrows 15. The concentrated river flow washes out the earth and sand 14 downstream to increase intake flow rate when the river water is taken out through the water intake 13 next time.

In the flexible membraneous weir in the prior art, the position of the V-notch deformation was indeterminent, hence there was a fear that V-notch deformation might be generated at an inadequate position, hence a river bed would be subjected to unexpected erosion and a shape of the river would be changed. However, according to the present invention, by mounting a rigid fin at a proper portion of a flexible membraneous body, V-notch deformation can be formed surely at a desired location, thereby a flow rate distribution along the river width direction at a membraneous weir can be controlled appropriately and a shape of a river can be maintained.

In addition, since the mounting of the rigid fin is also a simple procedure that it is fixedly secured to an appropriate portion of a membraneous body by bonding or fastening of bolts, construction expense as well as construction length can be reduced.

Figure 5:
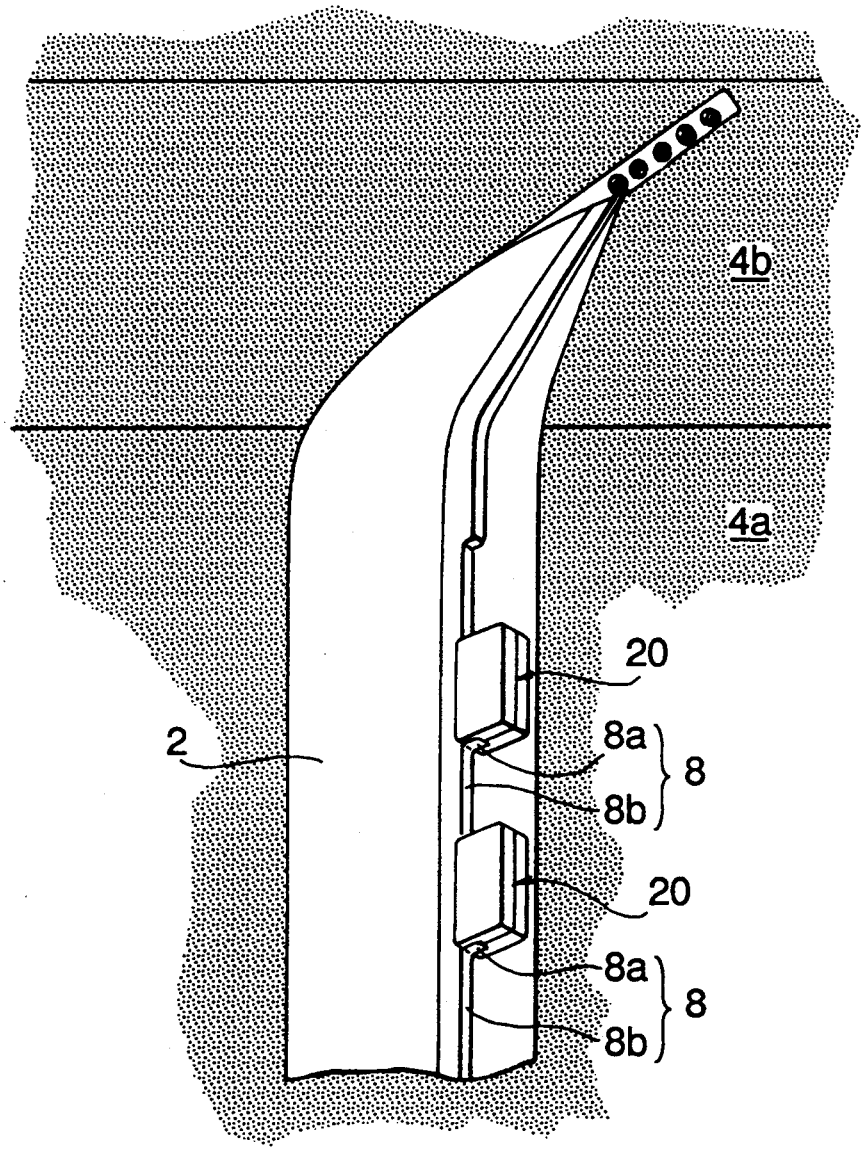
FIG. 5 is a partial plan view showing a membraneous weir according to another preferred embodiment of the present invention.

It is to be noted that while the rigid fin 10 was fixedly secured so as to bridge across adjacent protruded portions 8*a* of the fin 8 in the above-described embodiment, rigid fins 20 could be fixedly secured to the respective ones of the protruded portions 8*a* at a desired location to extend the corresponding protruded portions 8*a* as shown in FIG. 5.

Figure 6:
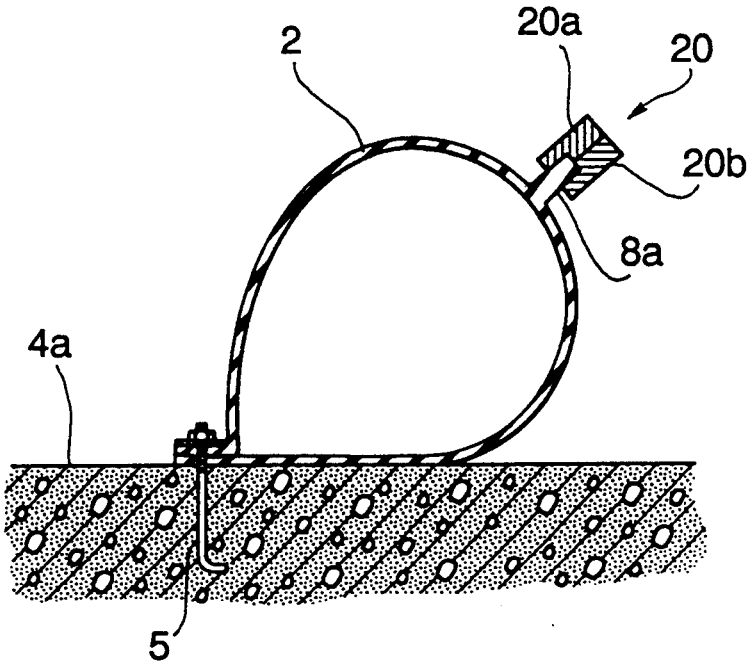
FIG. 6 is a vertical cross-section view of the same membraneous weir.

As shown in cross-section in FIG. 6, the rigid fin 20 is formed of a pair of rectangular plates 20*a* and 20*b* so as to pinch the protruded fin portion 8*a*, and in the rectangular plates 20*a* and 20*b* are formed grooves for receiving the protruded fin portion 8*a*. The rectangular plates 20*a* and 20*b* could be fixed by bonding or fixed by fastening bolts.

Figure 7:
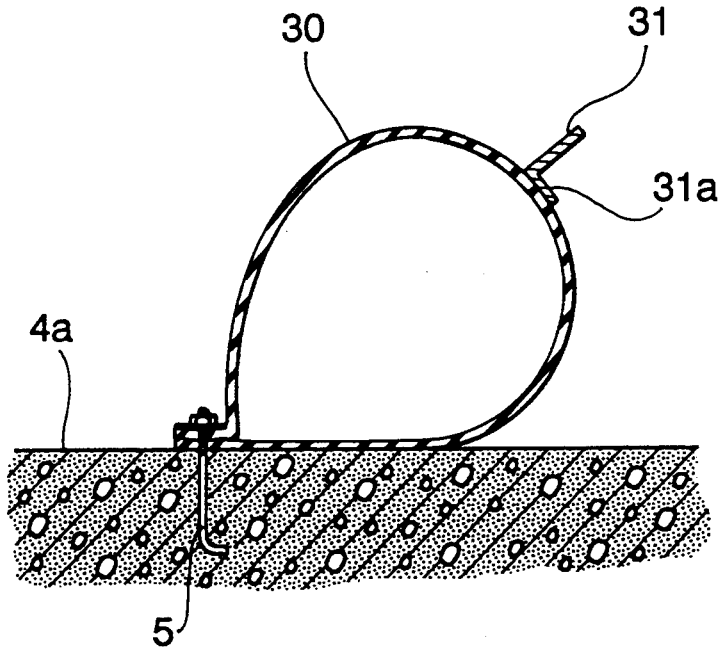
FIG. 7 is a vertical cross-section view of a membraneous weir according to still another preferred embodiment of the present invention.

Although the flexible membrane itself had a fin for preventing vibrations in the above-described preferred embodiment, even in the case of a membraneous body not having such a fin, a rigid fin 31 having an L-shaped cross-section can be fixedly secured with its one side piece 31*a* to a desired location of the surface of a membraneous body 30 by bonding or by fastening bolts as shown in FIG. 7.

Accordingly, the rigid fin can be simply mounted even to a membraneous body of a flexible membraneous weir in the prior art which is not provided with a fin for preventing vibrations, and so, highly efficient intake of water as well as maintenance of a shape of rivers can be realized simply and easily.

While a principle of the present invention has been described above in connection to preferred embodiments of the invention, it is a matter of course that many apparently widely different embodiments can be made without departing from the spirit of the invention.

What is claimed is:

1. A flexible membraneous weir comprising; a bag made of a flexible membrane such as a rubber membrane laid on a river bed across a river and adapted to be erected or collapsed by charging or discharging fluid to or from said bag; a rigid fin projecting from the outer surface of said flexible membrane when said flexible membraneous weir is erected, said rigid fin provided partially at a predetermined location along a river width direction of the outer surface of said flexible membrane; a fin extending continuously along the river width direction is formed on the surface of said bag, and protruded portions and recessed portions are alternately formed along a edge portion of said fin; and wherein said rigid fin is fixedly secured to said continuous fin to straddle across adjacent ones of said protruded portions and to project further than said protruded portions.

2. A flexible membraneous weir as claimed in claim 1, wherein said flexible membraneous weir is laid at downstream side of a water intake which is provided in either bank of the river and branches off from the river, and said rigid fin is provided on the outer surface of the flexible membrane at a longitudinal end portion near to the bank provided with the water intake.

3. A flexible membraneous weir as claimed in claim 1, wherein said rigid fin is fixedly secured directly to the outer surface of said flexible membrane.

4. A flexible membraneous weir comprising; a bag made of a flexible membrane such as a rubber membrane laid on a river bed across a river and adapted to be erected or collapsed by charging or discharging fluid to or from said bag; a rigid fin projecting from the outer surface of said flexible membrane when said flexible membraneous weir is erected, said rigid fin provided partially at a predetermined location along a river width direction of the outer surface of said flexible membrane; a fin extending continuously along the river width direction is formed on the surface of said bag, and protruded portions and recessed portions are alternately formed along a edge portion of said fin; and wherein said rigid fin is fixedly secured to said continuous fin in the form of extending said protruded portions.

5. A flexible membraneous weir as claimed in claim 4, wherein said rigid fin is made of a material having a young's modulus of at least 200 kgf/mm$^2$.

6. A flexible membraneous weir as claimed in claim 4, wherein said rigid fin has a length of at least 500 mm in said river width direction.

7. A flexible membraneous weir as claimed in claim 4, wherein said rigid fin has a length less than one-half of a width of the river it spans.

* * * * *